US006809279B2

(12) United States Patent
Allmen

(10) Patent No.: US 6,809,279 B2
(45) Date of Patent: Oct. 26, 2004

(54) SPRING LOADED MECHANICAL CONTROL MECHANISM FOR A CIRCUIT BREAKER COMPRISING A TOOTHED WHEEL COOPERATING WITH A COG WHEEL

(75) Inventor: Peter Von Allmen, Buchs Ag (CH)

(73) Assignee: Alstom, Paris (FR)

( * ) Notice: Subject to any disclaimer, the term of this patent is extended or adjusted under 35 U.S.C. 154(b) by 0 days.

(21) Appl. No.: 10/452,281

(22) Filed: Jun. 3, 2003

(65) Prior Publication Data

US 2004/0003989 A1 Jan. 8, 2004

(30) Foreign Application Priority Data

Jun. 6, 2002 (FR) ..... 02 06982

(51) Int. Cl.[7] ..... H01H 3/40; H01H 33/42; F16H 55/14

(52) U.S. Cl. ..... 200/501; 74/457; 218/154

(58) Field of Search ..... 200/501, 400; 218/154; 74/457–466

(56) References Cited

U.S. PATENT DOCUMENTS 5,046,378 A * 9/1991 Bannister et al. ..... 74/461
5,723,836 A 3/1998 Okuno et al.
5,981,889 A 11/1999 Niklaus

FOREIGN PATENT DOCUMENTS

EP 0 294 561 A 12/1988
EP 0 917 168 A 5/1999

OTHER PUBLICATIONS

Patent Abstracts of Japan, vol. 013, No. 416 (E–821), Sep. 14, 1989 & JP 01 154418 A (Mitsubishi Electric Corp), Jun. 1989.

* cited by examiner

*Primary Examiner*—James R. Scott
(74) *Attorney, Agent, or Firm*—Sughrue Mion, PLLC

(57) ABSTRACT

The spring-loaded mechanical control mechanism for a circuit-breaker in a high-voltage or medium-voltage grid comprises a toothed wheel turned by a spring from a first angular position to a second angular position, and a cog wheel co-operating with the toothed wheel to displace it from the second angular position to the first angular position so as to tension said spring. The toothed wheel has a peripheral set of teeth including a retractable segment on which at least four teeth are spaced apart from one another at a constant pitch identical to the pitch of the primary teeth.

7 Claims, 5 Drawing Sheets

IND
DIR
7
2
1
9C
9A
5'
5
9B
8'
8
6
6'
3
4'
10
12
4''
4

SPRING LOADED MECHANICAL CONTROL MECHANISM FOR A CIRCUIT BREAKER COMPRISING A TOOTHED WHEEL COOPERATING WITH A COG WHEEL

The invention relates to a spring-loaded mechanical control mechanism for a circuit-breaker in a high-voltage or medium-voltage grid, said control mechanism comprising a toothed wheel turned by a spring from a first angular position to a second angular position, and a cog wheel co-operating with the toothed wheel to displace it from the second angular position to the first angular position so as to tension said spring, said toothed wheel having a peripheral set of teeth constituted firstly by a primary set of teeth secured to the wheel, and secondly by a portion of a set of teeth in the form of a retractable toothed segment, said primary set of teeth having a constant pitch.

BACKGROUND OF THE INVENTION

A "circuit-breaker in a high-voltage or medium-voltage grid" is to be understood as covering any interrupting switchgear designed for an electricity grid whose operating voltage is greater than 1 kV.

The invention may firstly be applied to a mechanical control mechanism in which the toothed wheel is secured to a single control shaft coupled to a moving contact of the circuit-breaker in order to close the circuit-breaker by the engagement spring relaxing, the spring thereby driving the wheel. The invention may also be applied to a control mechanism in which the toothed wheel is secured to an "engagement" first shaft which is coupled to the moving contact via a "main" second shaft, as generally applies in latest-generation control mechanisms for high-voltage circuit-breakers.

It should be noted that, independently of whether or not the control mechanism has a single shaft, the coupling between the shaft(s) and a moving contact of the circuit-breaker is not reversible, i.e. the engagement spring may be re-tensioned by turning the cog wheel after the circuit-breaker has closed without causing said circuit-breaker to open. The cog wheel is driven by an electric motor to re-load the control mechanism, and the toothed wheel turns in the same direction when the engagement spring relaxes, and when it is re-tensioned by the motor.

The term "spring" is generally used below to designate the engagement spring which is connected to the toothed wheel and which is suitable for driving it.

At the end of re-loading of the spring, the toothed wheel is stopped from turning when said toothed wheel reaches the first angular position which corresponds substantially to the spring tension being at its maximum. A pawl is generally disposed facing a cam constrained to move with the toothed wheel so that the cam comes into abutment against said pawl when the toothed wheel reaches the first angular position. The pawl is generally hinged so that, by being disengaged, it releases the toothed wheel and triggers closure of the circuit-breaker by means of the spring relaxing.

Stopping the motor by interrupting its electrical power supply is not suitable for bringing the toothed wheel to a stop with sufficient accuracy, because the inertia of the motor delays such a stop. Such a control mechanism thus generally further comprises a mechanical device for decoupling the motor from the toothed wheel when it reaches its first angular position. Without such a device, the forces generated by the inertia of the motor in the teeth and in the pawl would give rise to considerable wear of the control mechanism, which would rapidly lead to its destruction.

Patent Document EP 0 917 168 discloses a large number of component elements which can be used in a mechanical control mechanism of the invention. The toothed wheel includes a plurality of teeth that can slide towards the inside of the toothed wheel, those sliding teeth being situated in a zone of the toothed wheel that corresponds to the position of the cog wheel when the toothed wheel is in the first angular position. Each sliding tooth is suitable for retracting by sliding radially against a return spring which is specific to it. More particularly, each sliding tooth has an asymmetrical profile with a tooth head forming a sloping surface, so that, when they mesh with the cog wheel, the sliding teeth retract under the thrust force to which they are subjected from the cog wheel, thereby mechanically decoupling the motor from the toothed wheel. Those sliding teeth are spaced apart at a distance significantly larger than the pitch of the teeth on the remainder of the toothed wheel, so as to facilitate re-meshing with the cog wheel when the spring relaxes.

Such a configuration requires a sliding system for each tooth, which represents significant extra machining and manufacturing cost. Furthermore, the retractable teeth have a special profile, each of them including a tooth head in the form of a sloping surface, which further increases the manufacturing cost.

A control mechanism is known from patent document JP 01154418, said control mechanism comprising a cog wheel and a toothed wheel having a peripheral set of teeth that included a toothed segment that is retractable. The segment comprises two teeth spaced apart from each other at a distance corresponding substantially to twice the regular pitch of the primary set of teeth. When the segment is in its deployed position, each of its two teeth is at the same distance from the closest tooth to the primary set of teeth.

However, as explained in the preamble of patent document U.S. Pat. No. 5,723,836, this configuration is not satisfactory. In that document, it is stated that decoupling the cog wheel and the toothed wheel implies oscillation of the retractable segment such that collisions between the teeth of the cog wheel and the tooth at the oscillating end of the segment risk causing surface damage to at least one tooth. Consequently, rigorous examination of the surface state of the teeth is necessary in order to limit the risk of such damage, thereby leading to an increase in the manufacturing cost of the control mechanism.

OBJECTS AND SUMMARY OF THE INVENTION

While retaining the principle of a circuit-breaker control mechanism in which the teeth of the toothed wheel include teeth disposed on a retractable segment, an object of the invention is to remedy the drawbacks of the state of the art by providing a system that is more reliable, for a lower manufacturing cost.

To this end, the invention provides a spring-loaded mechanical control mechanism for a circuit-breaker in a high-voltage or medium-voltage grid, said control mechanism comprising a toothed wheel turned by a spring from a first angular position to a second angular position, and a cog wheel co-operating with the toothed wheel to displace it from the second angular position to the first angular position so as to tension said spring, said toothed wheel having a peripheral set of teeth constituted firstly by a primary set of teeth secured to the wheel, and secondly by a portion of a set of teeth in the form of a retractable toothed segment, said primary set of teeth having constant pitch, wherein said retractable segment comprises at least four teeth spaced apart from one another at the same constant pitch as the pitch of said primary teeth.

The retractable segment thus has a conventional set of teeth which requires no special machining, which further reduces the manufacturing cost of the control mechanism of the invention.

In a preferred embodiment of the invention, the segment is hinged in said toothed wheel via a first end, while being retained by a return spring urging it outwards into a deployed position. The return spring can advantageously be constituted by a V-shaped blade. The segment retracts naturally when it meshes with the cog wheel at the first end, so that it is not necessary to provide any mechanism for controlling the position of the retractable segment, which simplifies the control mechanism of the invention.

In another particular embodiment of the invention, the hinge is situated within a circle whose diameter is the same as the base diameter of the set of teeth of said toothed wheel. With this configuration, the cog wheel is decoupled from the wheel at the end of re-loading of the engagement spring, but it re-couples spontaneously with the toothed wheel when the return spring relaxes, even if the segment remains in a retracted position after the motor has stopped completely.

Advantageously, the hinge of the segment comprises a pin which is positioned at a distance from the base diameter lying in the range one to two times the distance between the base diameter and the pitch diameter. This disposition, which allows substantially tangential movement in addition to the generally radial movement of the teeth of the retractable segment, allows anticipated meshing of the cog wheel in the teeth of the retractable segment so as to further decrease the pressing forces between the teeth of the cog wheel and of the segment, and thereby improve the life time of the control mechanism of the invention.

In yet another particular embodiment of the invention, the segment retracts into the thickness of the toothed wheel between two plates forming side plates of the toothed wheel. Thus, the toothed wheel is compact, and the set of teeth can be formed by cutting the plates.

BRIEF DESCRIPTION OF THE DRAWINGS

The invention is described below in more detail with reference to the accompanying drawings which show an embodiment by way of non-limiting example, and in which.

MORE DETAILED DESCRIPTION

Figure 1:
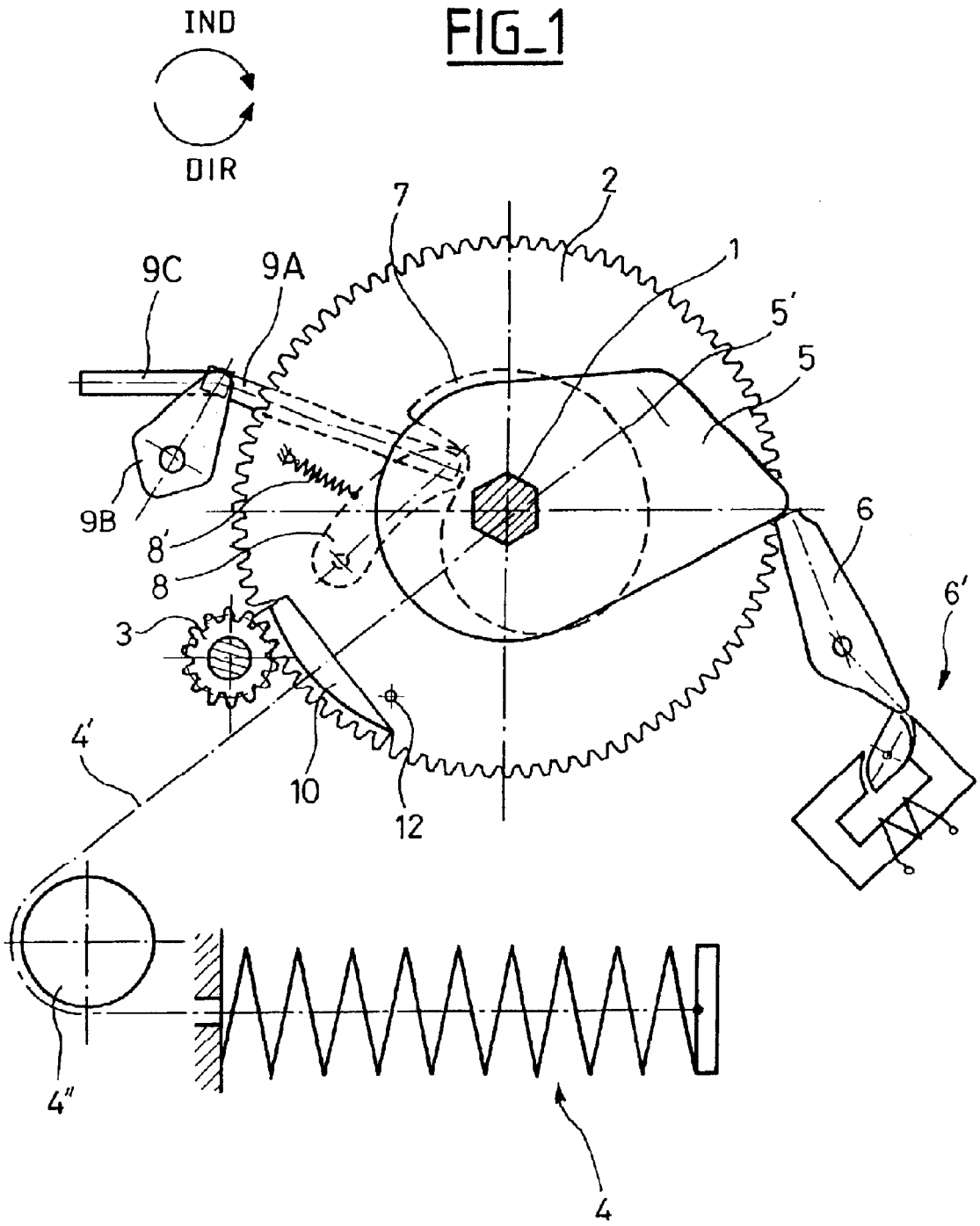
FIG. 1 is a diagrammatic view of a system for re-loading the spring in a mechanical control mechanism of the invention.

As shown in FIG. 1, the re-loading system for re-loading the mechanical control mechanism of the invention includes an engagement shaft 1, a large-diameter toothed wheel 2 mounted on said engagement shaft, and a drive motor (not shown) coupled to the toothed wheel 2 via a cog wheel 3. The moving contact of the circuit-breaker is coupled to the engagement shaft, in particular via a main shaft that is known per se and not shown.

The engagement spring 4 serves to drive the engagement shaft 1 to cause the circuit-breaker to close. The spring 4 has a first end connected to a first cam 5 which is secured to the end of the engagement shaft 1, and a second end coupled to the frame of the control mechanism. More particularly, the first end of the spring 4 is coupled to an anchor point 5' on the first cam via a cable 4' or a chain passing over a deflector pulley 4". The anchor point 5' on the first cam 5 is eccentric relative to the engagement shaft 1, so that, when the engagement shaft is in a first angular position shown in FIG. 1, the spring 4 is tensioned and exerts a drive force urging the engagement shaft in the clockwise direction IND in the figure. The first angular position is close to a top dead center position corresponding to maximum tension on the spring 4.

The engagement shaft is prevented from being rotated under the action of the spring 4 by a trigger pawl 6 engaged against the first cam 5. Angularly displacing the pawl 6 makes it possible to release the first cam 5, thereby allowing the engagement shaft 1 to rotate. In the example shown in the figures, the pawl is displaced by an electromagnet system 6' that is known per se. Under the effect of the spring 4 relaxing, the engagement shaft 1 is turned in the clockwise direction IND through about 180°, from its first angular position to a second angular position substantially corresponding to a bottom dead center.

The motor that drives the cog wheel 3 when it is electrically powered serves to return the engagement shaft 1 to its first angular position by causing it to turn through about 180° also in the clockwise direction IND, so that the control mechanism is loaded again, in the position shown in FIG. 1.

In known manner, the motor is mechanically decoupled from the toothed wheel when said wheel reaches the first angular position, by means of a segment having retractable teeth being implemented. The peripheral set of teeth of the toothed wheel 2 is constituted firstly by a primary set of teeth secured to the wheel, and secondly by a portion of a set of teeth in the form of a retractable toothed segment 10. This segment is disposed at the periphery of the toothed wheel 2 in a zone corresponding to the position of the cog wheel 3 when the toothed wheel is in the first angular position. The segment 10 may, for example, be mounted to slide relative to the toothed wheel 2 so as to be capable of sliding in a movement that is generally radial relative to the engagement shaft.

When the toothed wheel 2 reaches the first angular position, the segment 10 retracts so as to decouple the cog wheel 3. More particularly, when the segment 10 retracts, the teeth that it carries move towards the engagement shaft, so as to disengage the cog wheel 3 from the toothed wheel 2.

In the invention, the retractable segment 10 comprises at least four teeth spaced apart from one another at the same constant pitch as the pitch of the primary teeth. Thus, when the segment 10 is in a deployed position, its teeth are situated in continuity with the primary teeth on the toothed wheel 2 so as to mesh with the cog wheel 3.

In addition, the teeth 10 on the segment are normal teeth that are identical to the teeth on the primary set of teeth. A minimum number of four teeth turns out to be necessary for a segment 10 in a control mechanism of the invention.

Preferably, a number of teeth lying in the range eight to twenty is adopted in most embodiments of mechanical control mechanisms of the invention.

Thus, the teeth on the segment 10 can be formed by a conventional machine tool designed for machining gear teeth, which significantly reduces the cost of manufacturing the control mechanism of the invention, while also making it possible to improve operating reliability.

For example, the segment may retract under the effect of a mechanism controlling its radial position as a function of the angular position of the toothed wheel. Advantageously, in conventional manner, a return spring 11 shown diagrammatically in FIG. 2 tends to hold the segment 10 in the deployed position, so that said segment 10 retracts spontaneously as soon as the cog wheel 3 meshes with it, as described in more detail below.

Figure 2:
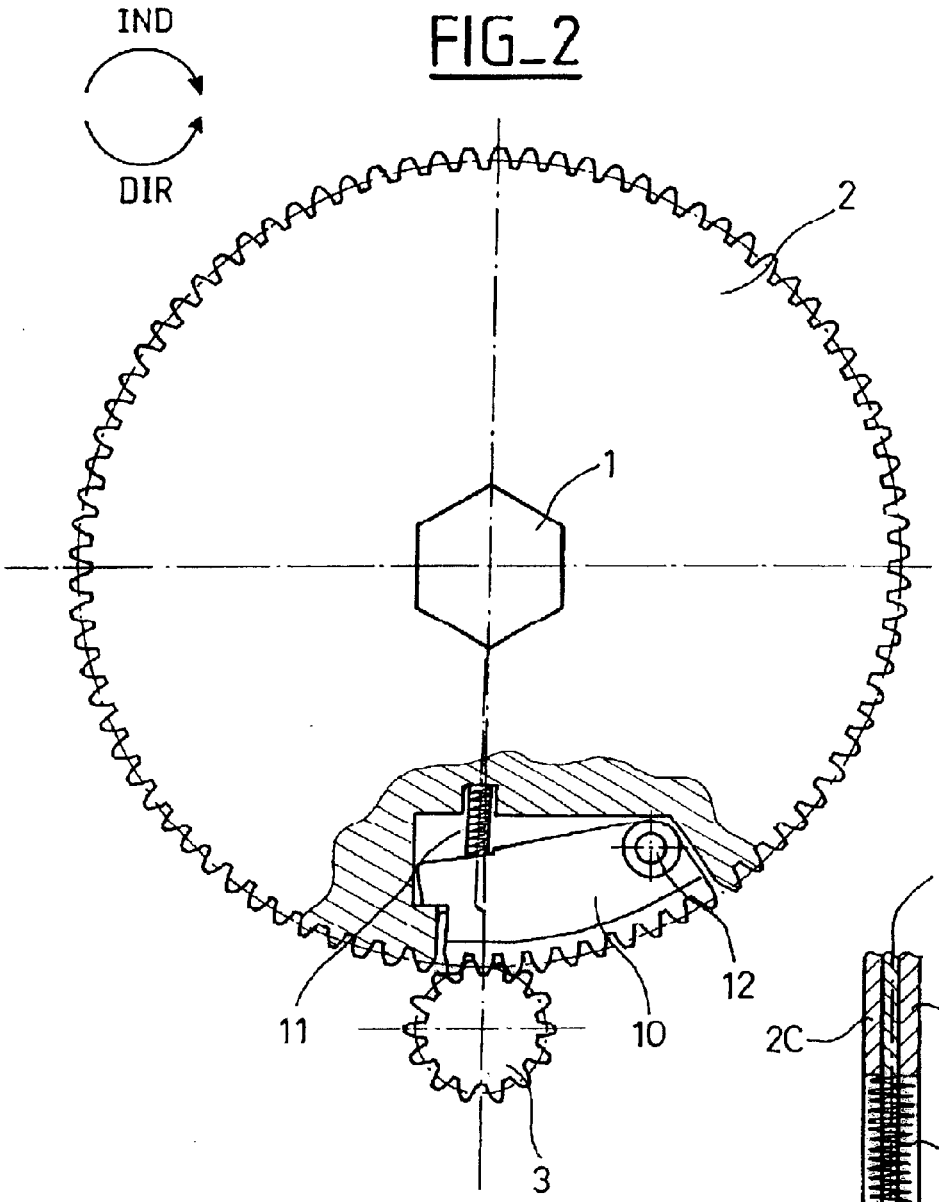
FIG. 2 is a view of the toothed wheel of the re-loading system shown in FIG. 1.

In a preferred embodiment, the segment 10 has a first end fixed to the toothed wheel 2 via a hinge 12 and its other end in abutment against the return spring 11 which is secured to the toothed wheel. In the embodiment shown in the figures, the hinge is formed by a pin 12 fixed to the toothed wheel and about which the segment 10 can pivot. As shown in FIG. 2, the return spring 11 is a helical spring in this example that extends radially while having one end in abutment against the segment 10 and its other end in abutment against the toothed wheel 2. The retractable segment 10 can advantageously be made of a plastics material such as a polymer in such a manner as to form, for example, a single piece made by molding and including two projections forming the hinge pin 12.

Figure 4:
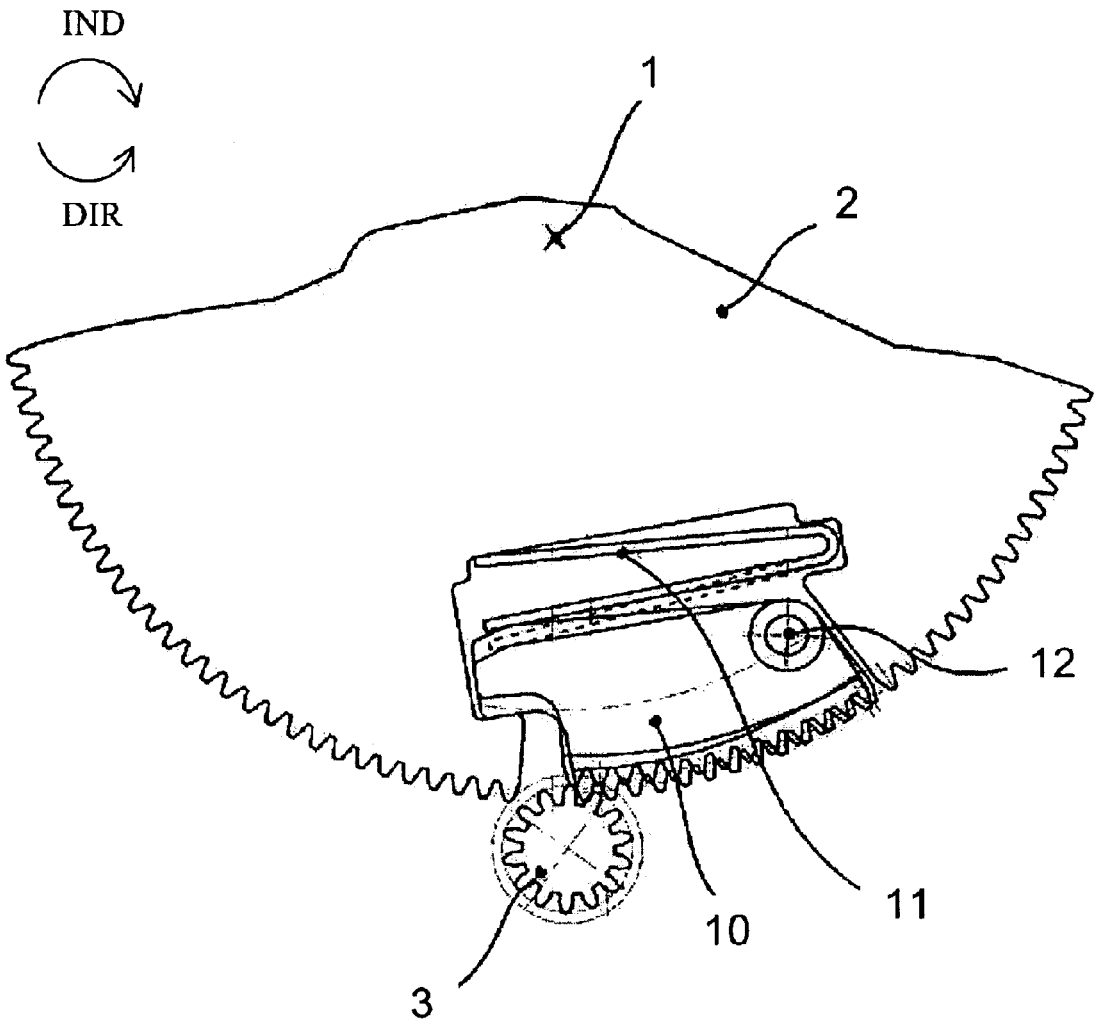
FIG. 4 is a section view of a variant of the toothed wheel of the re-loading system shown in FIG. 1.

A spiral spring situated at the hinge pin 12 with one end connected to the segment and its other end connected to the toothed wheel may also be considered without going beyond the ambit of the invention. Advantageously, it is possible for the recess that is provided for receiving the retractable segment 10 to be extended towards the central portion of the toothed wheel 2 far enough to enable a spring constituted by a V-shaped blade with a relatively small angle to be received between the wheel 2 and the inside edge of said segment 10. For example, such a spring 11 in which each of the straight portions of the V-shaped blade has approximately the same length as the retractable segment 10 and form between them an angle lying in the range 10° and 20° can be quite suitable, as shown in FIG. 4.

Figure 7:
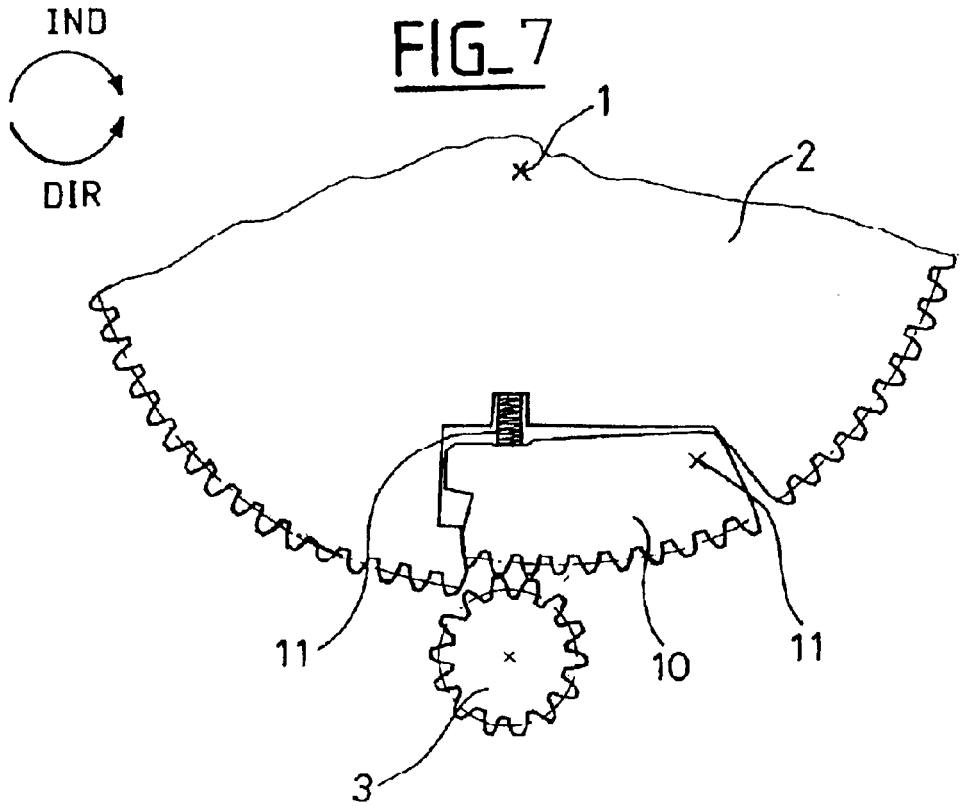
FIG. 7 is a third fragmentary view of the toothed wheel of the invention.

The segment 10 is thus capable of retracting by pivoting against the return spring 11. More particularly, when it is retracted, the segment forms a setback in the periphery of the toothed wheel 2: the teeth on the first end generally move in the radial direction of the toothed wheel 2 towards the engagement shaft, while the teeth on the second end that are close to the hinge move little, as shown in FIG. 7.

Figure 3:
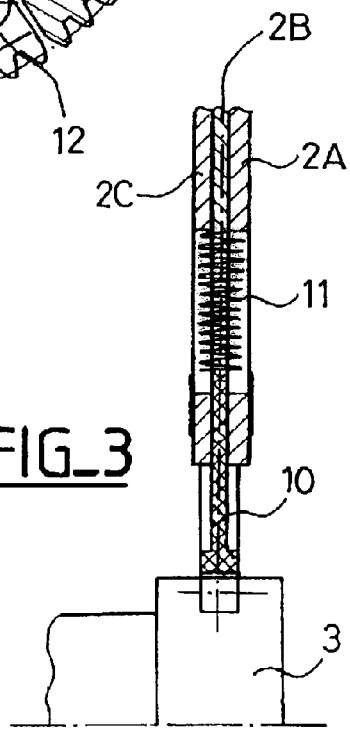
FIG. 3 is a section view of the toothed wheel shown in FIG. 2.

The segment and the return spring may advantageously be mounted in the thickness of the toothed wheel so that the segment retracts into the thickness of the toothed wheel making it more compact, as shown in FIG. 3 which is a fragmentary section view of the segment and of the return spring in a plane containing the engagement shaft 1.

More particularly, in this example, the toothed wheel 2 is made up of three steel plates 2A, 2B, and 2C in mutual abutment. The central plate 2B is provided with a large-size recess at the retractable segment 10, and it is clamped between the two side plates which form the side plates of the toothed wheel and are provided with smaller-size recesses in the zone of the retractable segment. Thus, the retractable segment is guided by the two side plates 2A and 2C between which it is free to slide radially. The hinge pin 12 which passes through the segment 10 has each of its ends fixed to a respective side plate 2A, 2C. The recess in the central plate 2B in particular forms an abutment against which the second end of the segment 10 bears when it is deployed.

With this configuration, each plate is of small thickness, which makes it possible to form the teeth by cutting each plate instead of forming them by machining, thereby further reducing the cost of manufacturing the control mechanism of the invention. Thus, the teeth provided on each of the plates over its periphery except for the zone of the retractable segment constitute the teeth of the toothed wheel. The toothed wheel can also be made with a greater number of plates so as to form a thicker set of teeth while nevertheless forming said teeth by cutting instead of forming them by machining.

FIGS. 5 to 8 diagrammatically show operation of the system for re-loading the engagement spring 4 of the control mechanism, corresponding to re-loading the spring and then to triggering closure of the circuit-breaker by means of the control mechanism. During this operation, the toothed wheel turns in the clockwise direction IND in the figures.

Figure 5:
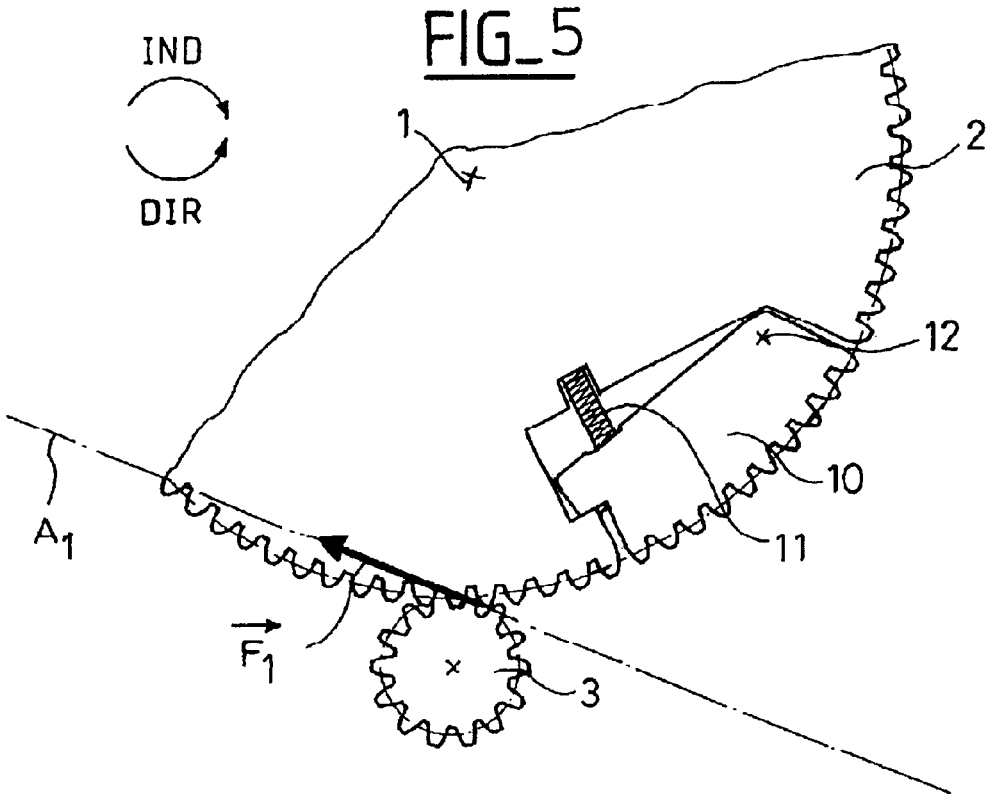
FIG. 5 is a first fragmentary view of the toothed wheel of the invention.

FIG. 5 shows a portion of the toothed wheel 2 when it is turned in the clockwise direction IND by the cog wheel 3 to reach its first angular position.

Figure 6:
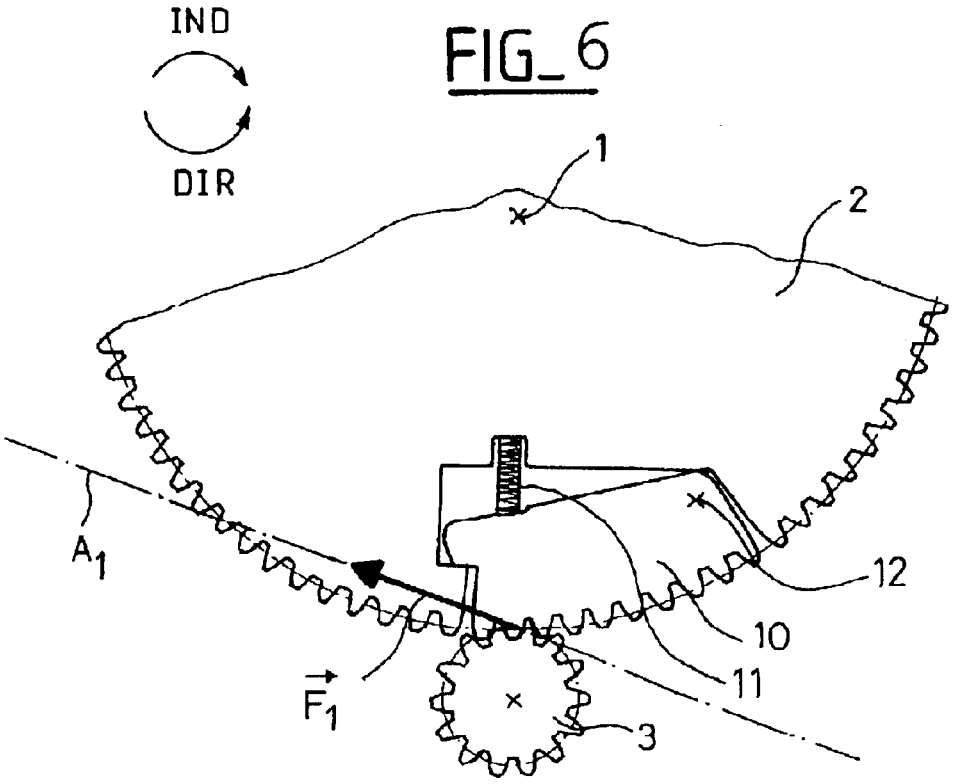
FIG. 6 is a second fragmentary view of the toothed wheel of the invention.

In FIG. 6, the cog wheel 3 has reached the first end of the segment 10 and initially meshes with the teeth of said segment, which corresponds substantially to the position in which the first cam 5 comes into abutment against the pawl 6. As shown in FIG. 6, the thrust forces $F_1$ from the cog wheel 3 against the teeth of the segment 10 act along an axis $A_1$ that is substantially slanting and that is positioned such that the hinge 12 lies between said axis $A_1$ and the engagement shaft 1. More particularly, the thrust forces $F_1$ act from right to left on FIG. 6, such that they tend to turn the segment 10 in the clockwise direction IND about the pin 12 so that the segment retracts as soon as it meshes with the cog wheel 3.

As shown in FIG. 7, the segment thus retracts naturally, thereby mechanically decoupling the motor from the toothed wheel when said toothed wheel reaches the first angular position. After the end of rotation of the motor under the effect of its own inertia, the cog wheel 3 stops in an arbitrary angular position: it can be meshed with the segment 10 which is then in the deployed position; or else it can be disengaged from the segment which is then retracted as shown in FIG. 7.

Figure 8:
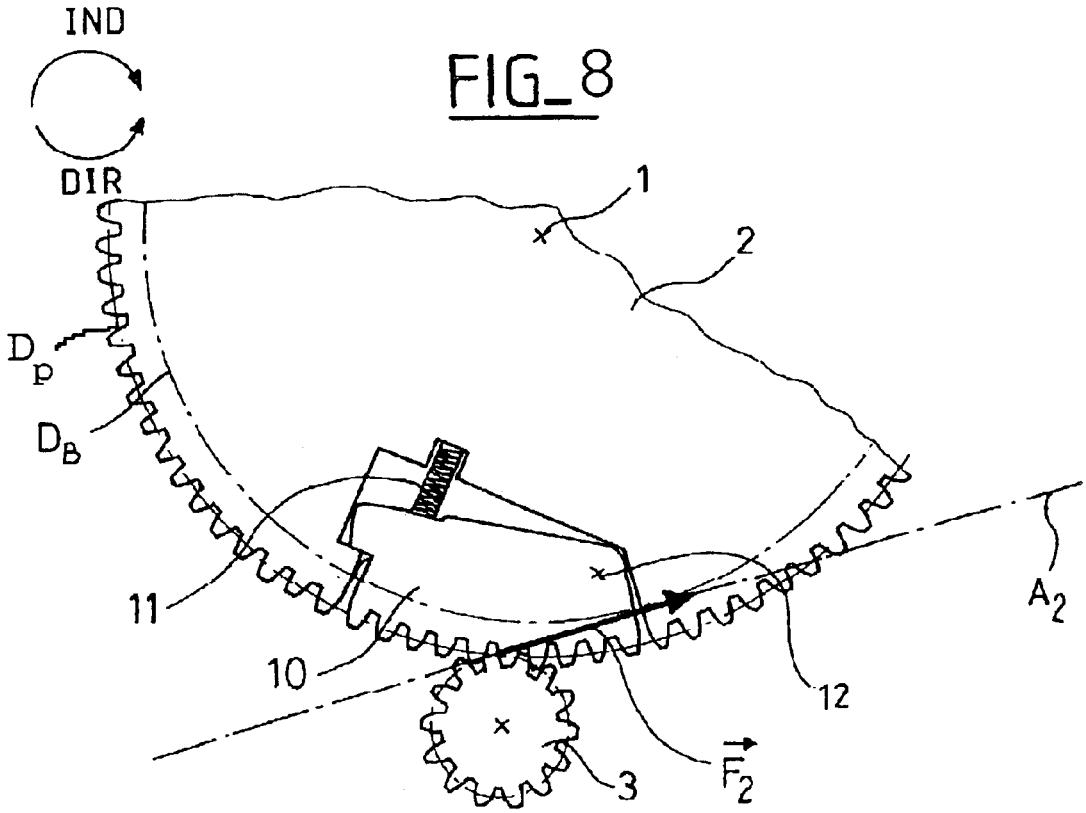
FIG. 8 is a fragmentary view of the re-loading system shown in FIG. 1, corresponding to different angular positions of the wheel.

While the spring 4 is relaxing, the toothed wheel 2 turns in the clockwise direction IND by rotating the cog wheel 3 regardless of which of the following situations occurs:

if the cog wheel has remained meshed with the segment 10, it is rotated directly; and if the segment has remained retracted, the return spring holds the teeth of the segment 10 in abutment against the teeth of the cog wheel 3 so that they re-mesh naturally after the toothed wheel has turned through a very small angle, which puts the two sets of teeth in phase with each other, as shown in FIG. 8.

To reduce the mechanical stresses on the teeth of the cog wheel, the cog wheel may be driven by the motor via a clutch-type system. Nevertheless, as explained below, the invention enables the mechanical stresses to be reduced such that direct driving of the cog wheel by the motor does not generally cause premature wear of the teeth of the cog wheel and/or of the retractable segment.

Thus, in a system for reloading the engagement spring of a control mechanism of the invention, the cog wheel 3 and the toothed wheel 2 decouple spontaneously when the wheel reaches the first angular position, and they re-couple spontaneously when the spring 4 relaxes.

As known to the person skilled in the art, the term "base diameter of the set of teeth" is used to designate the diameter $D_B$ which is given by the relationship $D_B=D_P\times\cos(\alpha)$, where $D_P$ designates the pitch diameter of the set of teeth, and $\alpha$ designates its pressure angle, for a standardized conventional set of teeth having an involute-to-circle profile.

In a preferred embodiment, the hinge 12 of the segment 10 is situated within a circle having the same center as the wheel 2 and having the same diameter as the base diameter $D_B$ of the set of teeth of the wheel 2, for the purpose of further facilitating re-meshing. More particularly, during relaxing of the spring 4, the thrust forces $F_2$ from the cog wheel 3 on the teeth of the segment 10 act along another axis $A_2$ that is also slanting. By positioning the hinge within the base diameter $D_B$, said other axis $A_2$ is situated such that the hinge 12 is situated between the engagement shaft and said other axis $A_2$. Since the toothed wheel is a driving wheel in this example, the forces $F_2$ act from left to right in FIG. 8, which tends to turn the segment 10 in the counterclockwise direction DIR so as to cause the segment to be deployed and thus to facilitate re-coupling of the cog wheel 3 with the teeth of the segment. Thus, the risk of the cog wheel 3 jamming is further minimized, which significantly improves the operating reliability of the control mechanism. As shown in FIG. 8, the base diameter of the set of teeth corresponds to the diameter of a circle centered on the wheel 2 and tangential to the axis $A_2$ and to the axis $A_1$.

Advantageously, the hinge pin 12 of the segment 10 is perceptibly distant from the base diameter $D_B$ of the toothed wheel 2 so that the displacement of the retractable teeth 10 takes place in a direction that is oblique relative to the radial direction of the toothed wheel 2. In other words, the nearer the hinge pin 12 is to the base diameter $D_B$, the more the displacement of the teeth of the retractable segment 10 is radial; and the farther said pin is from the base diameter $D_B$, the more said displacement is performed with a non-negligible tangential component along an axis tangential to the toothed wheel 2.

By positioning the hinge pin 12 at a certain distance from the base diameter $D_B$, the tangential component of the displacement of the teeth of the retractable segment 10 favors anticipated meshing of the cog wheel 3 of the motor, i.e. a meshing in a situation for which the segment 10 is not yet completely deployed, whereas the toothed wheel 2 begins to drive the cog wheel 3 in rotation. Continued meshing causes the segment 10 to be deployed spontaneously, as mentioned above. The pressing forces $F_2$ resulting from the meshing are thus reduced during deployment of the segment 10, compared with a system in which the hinge pin 12 is closer to the base diameter $D_B$ of the toothed wheel. The variation of said pressing forces is also not as sudden during said start-of-meshing stage.

The fact that the teeth of the retractable segment 10 can be displaced slightly in a tangential direction also allows mechanical decoupling to take place between the cog wheel 3 and the retractable segment 10 in relatively progressive manner when the cog wheel drives the toothed wheel 2 in rotation and when said toothed wheel reaches the first angular position as shown in FIG. 7.

Finally, the positioning of the hinge pin 12 at a certain distance from the diameter of the base $D_B$, and the disposition of the teeth of the retractable segment 10 spaced apart from one another at the same constant pitch as on the toothed wheel 2, contributes to improving the life time of a control mechanism of the invention, and also makes it possible to use a plastics material such as a polymer for making the retractable segment, without risk of the teeth of the segment being prematurely worn.

With regard to positioning the hinge pin 12, trials have shown that positioning it at a distance from the base diameter $D_B$ lying in the range one to two times the distance separating the base diameter $D_B$ of the pitch diameter $D_P$, leads to satisfactory performance of the control mechanism of the invention.

The control mechanism of the invention may further include an electrical power supply switch for controlling the power supply to the motor as a function of the angular position of the toothed wheel. In this other preferred embodiment, the control mechanism further includes a second cam 7 that is secured to the engagement shaft and that co-operates with a control lever 8, as shown in FIG. 1. The control lever 8 is rotatably mounted at a first end and its second end is held in abutment against the outline of the second cam 7 by a resilient element 8', which is a helical spring in this example. The control lever is constrained to move with an electrical switch (not shown) via three links 9A, 9B, 9C so as to control the electrical power supply to the motor. The outline of the second cam 7 forms a spiral arc which is centered on the engagement shaft and which loops back on itself via a setback. When the second end of the control lever 8 is placed in the setback of the outline of the cam 7, i.e. as close as possible to the engagement shaft 1, as shown in FIG. 1, the electrical switch is put in a position for interrupting the electrical power supply to the motor, which corresponds to the end of re-loading of the spring 4. When the second end of the control lever 8 is placed on a zone of the spiral arc that is close to the engagement shaft, the electrical switch is put in a position for causing the motor to be electrically powered so as to re-load the spring automatically after it has relaxed. The switch is thus actuated to interrupt the electrical power supply to the motor when the toothed wheel reaches the first angular position, while the retractable segment guarantees instantaneous decoupling of the motor. The switch causes the motor to be electrically powered just before or just after the spring has relaxed fully, so as to re-tension said spring, i.e. when the shaft reaches its second angular position. The spring-loaded mechanical control mechanism of the invention thus re-loads autonomously after each occasion on which the spring 4 relaxes.

What is claimed is:

1. A spring-loaded mechanical control mechanism for a circuit-breaker in a high-voltage or medium-voltage grid, said control mechanism comprising a toothed wheel turned by a spring from a first angular position to a second angular position, and a cog wheel co-operating with the toothed wheel to displace it from the second angular position to the first angular position so as to tension said spring, said toothed wheel having a peripheral set of teeth constituted firstly by a primary set of teeth secured to the wheel, and secondly by a portion of a set of teeth in the form of a retractable toothed segment, said primary set of teeth having constant pitch, wherein said retractable segment comprises at least four teeth spaced apart from one another at the same constant pitch as the pitch of said primary teeth.

2. A control mechanism according to claim 1, in which said segment is hinged in said toothed wheel via a pin fixed to a first end of said segment, and in which said pin is situated within the base diameter of the set of teeth of said toothed wheel.

3. A control mechanism according to claim 2, in which said axis is situated at a distance from the base diameter lying in the range one to two times the distance between the base diameter and the pitch diameter of the set of teeth.

4. A control mechanism according to claim 2, in which said segment is in abutment against a return spring urging it outwards into a deployed position, said return spring being constituted by a V-shaped blade, the straight portions of said blade forming an angle between them that lies in the range 10° to 20°.

5. A control mechanism according to claim 1, in which said segment retracts into the thickness of the toothed wheel.

6. A control mechanism according to claim 5, in which the segment retracts between two plates forming side plates of the toothed wheel.

7. A control mechanism according to claim 6, in which a central plate is clamped between the two plates, and in which each of the three plates are provided with teeth at their peripheries, which teeth make up the set of teeth of the toothed wheel.

* * * * *